US011096424B2

(12) United States Patent
Qiu

(10) Patent No.: US 11,096,424 B2
(45) Date of Patent: Aug. 24, 2021

(54) CONTROLLING APPARATUS WITH REMINDING FUNCTION FOR ELECTRONIC CIGARETTE AND CONTROL METHOD

(71) Applicant: CHANGZHOU JWEI INTELLIGENT TECHNOLOGY CO., LTD., Changzhou (CN)

(72) Inventor: Wei-Hua Qiu, ChangZhou (CN)

(73) Assignee: CHANGZHOU JWEI INTELLIGENT TECHNOLOGY CO., LTD., Changzhou (CN)

( * ) Notice: Subject to any disclaimer, the term of this patent is extended or adjusted under 35 U.S.C. 154(b) by 499 days.

(21) Appl. No.: 16/000,904

(22) Filed: Jun. 6, 2018

(65) Prior Publication Data

US 2018/0279689 A1 Oct. 4, 2018

Related U.S. Application Data

(63) Continuation-in-part of application No. PCT/CN2016/108645, filed on Dec. 6, 2016.

(30) Foreign Application Priority Data

Dec. 9, 2015 (CN) ..... 201510903001.1

(51) Int. Cl.
*H05B 1/02* (2006.01)
*A24F 40/53* (2020.01)
(Continued)

(52) U.S. Cl.
CPC ..... *A24F 40/53* (2020.01); *A24F 40/60* (2020.01); *H05B 1/02* (2013.01); *A24F 40/10* (2020.01)

(58) Field of Classification Search
CPC ..... A24F 47/008; H05B 1/02; H01J 7/007
(Continued)

(56) References Cited

U.S. PATENT DOCUMENTS 5,878,752 A * 3/1999 Adams ..... A24F 40/465 131/329
2010/0163063 A1* 7/2010 Fernando ..... A24F 40/57 131/184.1
(Continued)

FOREIGN PATENT DOCUMENTS

CN 103734915 A 4/2014
CN 104106842 A 10/2014
(Continued)

*Primary Examiner* — Mark H Paschall
(74) *Attorney, Agent, or Firm* — ScienBiziP, P.C.

(57) ABSTRACT

A controlling apparatus able to warn a user as to an old or malfunctioning atomizer head applied to an electronic cigarette, with a control method. A first detecting device detects value $a_N$ of loss factor when atomizing head operates for the Nth time, a timer records N times of operating and operating duration $t_N$. A storage stores a loss calculation formula, a preset threshold value of the accumulated total loss $D_N$, and loss data as to previous use of current atomizer head. A processor can acquire $a_N$, N and $t_N$, and loss calculation formula, and the loss data to calculate the operating loss $d_N$ and the total loss $D_N$, then store $d_N$ and $D_N$. Total loss $D_N$ is compared with the preset threshold value, and an alarming device transmits alarm signal if $D_N$ is equal to or greater than the preset threshold value.

8 Claims, 6 Drawing Sheets

(51) Int. Cl.
*A24F 40/60* (2020.01)
*A24F 40/10* (2020.01)

(58) Field of Classification Search
USPC ..... 219/506, 483–486, 497, 492, 494; 131/328, 329, 192
See application file for complete search history.

(56) References Cited

U.S. PATENT DOCUMENTS

| | | | | |
|---|---|---|---|---|
| 2013/0104916 | A1* | 5/2013 | Bellinger | A61M 16/024 131/328 |
| 2013/0340775 | A1* | 12/2013 | Juster | A24F 40/65 131/273 |
| 2014/0174458 | A1 | 6/2014 | Katz | |
| 2014/0230835 | A1 | 8/2014 | Saliman | |
| 2014/0278250 | A1 | 9/2014 | Smith et al. | |
| 2014/0345633 | A1* | 11/2014 | Talon | A61M 15/06 131/329 |

FOREIGN PATENT DOCUMENTS

| | | | |
|---|---|---|---|
| CN | 204670381 | U | 9/2015 |
| CN | 105394817 | A | 3/2016 |
| WO | 2014169437 | A1 | 10/2014 |

* cited by examiner

CONTROLLING APPARATUS WITH REMINDING FUNCTION FOR ELECTRONIC CIGARETTE AND CONTROL METHOD

FIELD

The present disclosure relates to an electronic cigarette, and more particularly to a controlling apparatus with reminding function, and a control method, for use with an electronic cigarette.

BACKGROUND

Electronic cigarette usage has become widespread. The electronic cigarette includes an atomizing head. A battery supplies power to the atomizing head, and a heating element heats the liquid tobacco attached to a liquid guiding element to generate smoke, thus a user acquires a smoking experience.

However, the condition of the atomizing head can deteriorate over time and electronic cigarette usage, through malfunction or simple extended usage of the electronic cigarette. A defective atomizer will result in smells of burnt tobacco and metal. Thus, if the atomizing head is not in optimal condition, but the user is unaware of this and continues to use the electronic cigarette and thus the atomizing head, the burnt smell of the liquid guiding element and the metallic smell of the heating element will be mixed in the smoke, resulting in a poor electronic smoking experience.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

In order to make the above-mentioned objects, features, and advantages of the present application more obvious, a description of specific embodiments of the present application will be described with reference to the accompanying drawings. The present application can be implemented in many ways different from those described herein, and those skilled in the art can make similar improvements without violating the contents of the present application. Therefore, the present application is not to be considered as limiting the scope of the embodiments to those described herein.

Several definitions that apply throughout this disclosure will now be presented.

Unless otherwise defined, all technical and scientific terms used herein have the same meaning as commonly understood by one skilled in the art. The terms used in a specification of the present application herein are only for describing specific embodiments, and are not intended to limit the present application.

Figure 1:
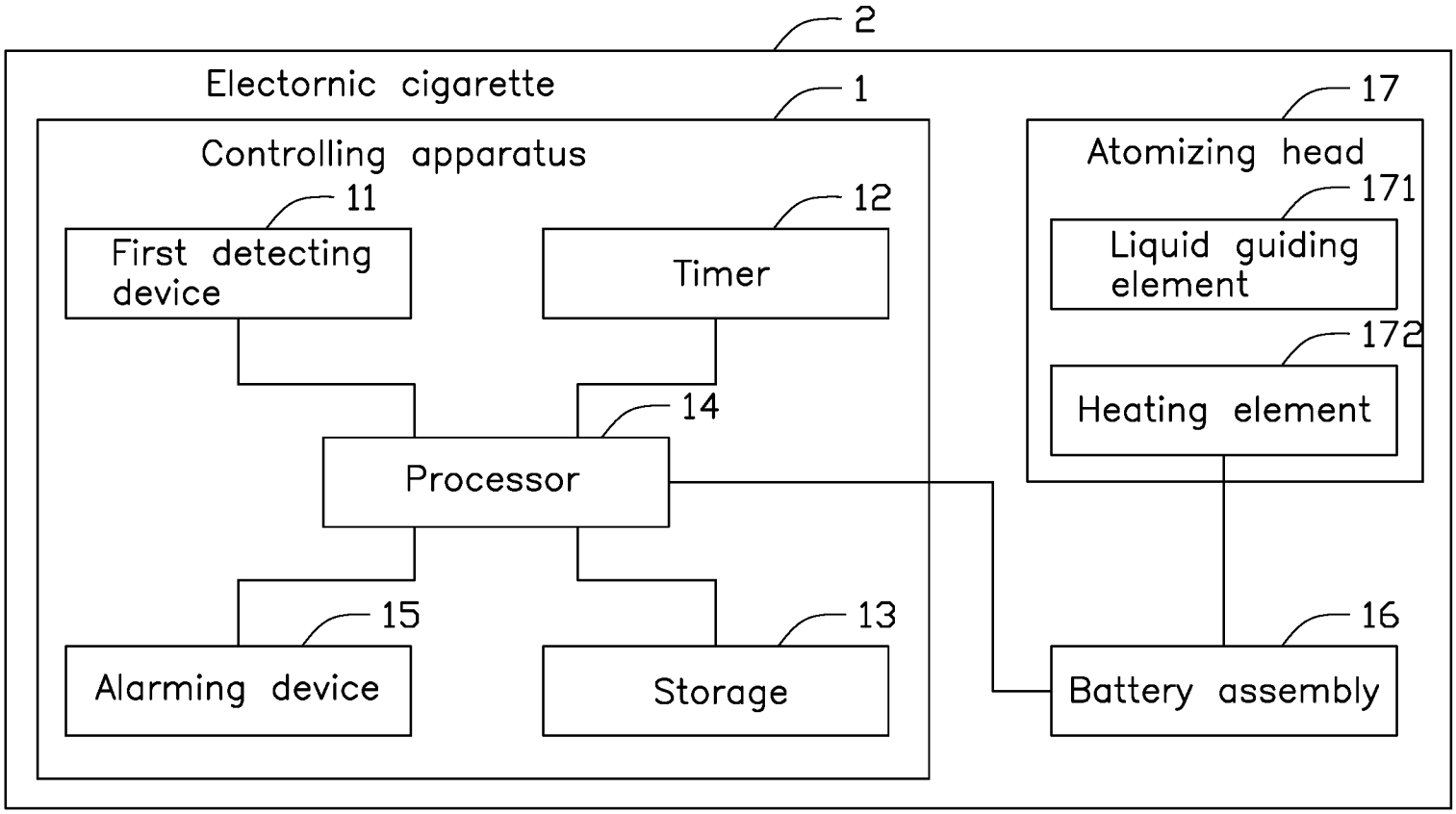
FIG. 1 is a block diagram of a first embodiment of an electronic cigarette with reminding function.

Referring to FIG. 1, the present disclosure provides a controlling apparatus 1 with reminding function. The controlling apparatus 1 includes a first detecting device 11, a timer 12, a storage 13, a processor 14, and an alarming device 15. The first detecting device 11 is configured to detect a value $a_N$ of a loss factor when an atomizing head 17 working an Nth time. "N" presents the number of times that the atomizing head 17 has operated, and $N \geq 1$. The timer 12 is configured to record the individual number of operations N of the atomizing head 17 and an operation duration $t_N$ at the Nth time. The storage 13 is configured to pre-store a loss calculation formula for the atomizing head 17 and a preset threshold value of the total loss $D_N$. The loss calculation formula includes a loss calculation formula of the electronic cigarette operating for each use $d_N=\eta_N \times a_N \times t_N$, a corresponding relational data of $\eta_N$ and N, and a total loss calculation formula $D_N=D_{N-1}+d_N$ after N operations. The $\eta_N$ is defined as the correction factor, and $D_0=0$. The storage 13 is further configured to store loss data of the atomizing head 17. The loss data includes an operating loss calculated for each electronic cigarette operation and a total loss of the atomizing head 17 after the electronic cigarette operating for N times. The processor 14 is configured to acquire the value of $a_N$ from the first detecting device 11, to acquire the value of N and $t_N$ from the timer 12, and to acquire the loss calculation formula and the loss data from the storage 13, to calculate the operation loss $d_N$ of the atomizing head 17 at the electronic cigarette operating for each time and the total loss $D_N$ after the electronic cigarette operating for N times. The processor 14 is configured to store the $d_N$ and the $D_N$ in the storage 13, and to compare the total loss $D_N$ with the preset threshold value. When the total loss $D_N$ is greater than or equal to the preset threshold value, the processor 14 instructs the alarming device 15 to transmit an alarm signal. The alarming device 15 is configure to transmit the alarm signal. The alarming device 15 can transmit the alarm signal by methods of vibration, ringing, displaying reminding message, or indicating lights.

In the illustrated embodiment, the loss calculation formula, the preset threshold value of the total loss $D_N$, and the loss data of the atomizing head 17 are stored in the storage 13. In actual application, the loss calculation formula, the preset threshold value of the total loss $D_N$, and the loss data of the atomizing head 17 can be stored in other device or a cloud. Additionally, different elements can be stored in different devices.

Additionally, the illustrated embodiment is an example of the corresponding relational data of $\eta_N$ and N. In actual application, $\eta_N$ can be a preset value. When the $\eta_N$ is the preset value, the timer 12 doesn't need to record the number of operations N. The loss calculation formula is taken as an example in the illustrated embodiment, in actual application, other formulas can be used. For example, $d_N=\eta_N \times a_N \times t_N+b$, b is a constant.

The value $a_N$ of the loss factor, the number of operations N and the operation duration $t_N$ of the atomizing head 17 can be detected in real time. According to the loss calculation formula and the loss data of the atomizing head 17, the operation loss $d_N$ of the Nth time and the total loss $D_N$ of N times of the atomizing head 17 are calculated. When the total loss $D_N$ is greater than or equal to the preset threshold value, an alarm signal reminding a user to change the atomizing head 17 is transmitted. Therefore, users can change the atomizing head 17 in a timely fashion. The user experience can thus be improved.

The loss factor is a factor affecting the atomizing head 17 during operation. The factor affected may include at least one of: the operating voltage of the atomizing head 17, the operating power of the atomizing head 17, the operating temperature of the atomizing head 17, the operating humidity of the atomizing head 17, and the pH value of the liquid tobacco.

In an alternative embodiment (not shown in drawings), the storage 13 of the controlling apparatus 1 is arranged in the atomizing head 17. The first detecting device 11, the timer 12, the processor 13, and the alarming device 15 of the controlling apparatus 1 are arranged in a battery assembly 16. The atomizing head 17 further includes a liquid guiding element 171 and a heating element 172. Since the storage 13 is arranged in the atomizing head 17, the battery assembly 16 can be fitted with at least one type of atomizing head 17, the storage 13 can be update when a replacement of the atomizing head 17 is fitted.

In an alternative embodiment (not shown in drawings), the first detecting device 11, the timer 12, the storage 13, the processor 14 and the alarming device 15 of the controlling apparatus 1 are arranged in the battery assembly 16. An atomizing head 17 includes a liquid guiding element 171 and a heating element 172. Since the storage 13 is arranged in the battery assembly 16, the storage 13 is not update when a replacement of the atomizing head 17 is fitted. The controlling apparatus 1 does not have a function of identifying different types of the atomizing head 17, the storage 13 stores only the loss calculation formula and the preset threshold value of total loss $D_N$ for the type of atomizing head 17 being used, and the battery assembly 16 can only work with one type of the atomizing head 17. When a new atomizing head 17, whose type is different from the prior type of atomizing head 17, is fitted to the battery assembly, the loss data of the previous atomizing head 17 stored in the storage 13 is deleted.

Figure 2:
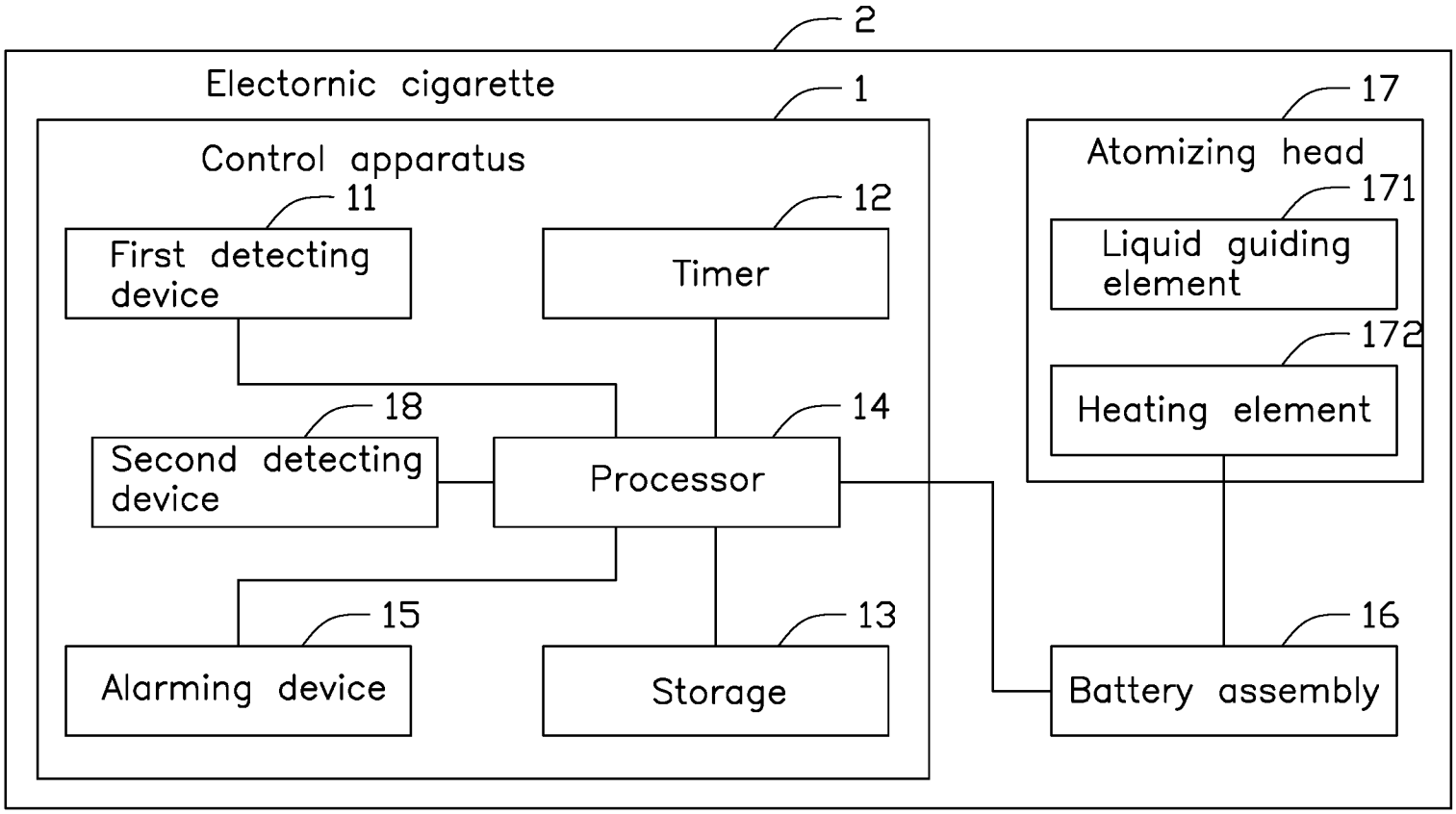
FIG. 2 is a block diagram of a second embodiment of an electronic cigarette with reminding function.

Referring to FIG. 2, in an alternative embodiment, the controlling apparatus 1 further includes a second detecting device 18. The second detecting device 18 is configured to detect a type of atomizing head 17 via identifying information associated with the atomizing head 17, and to instruct the processor 14 to obtain from storage 13 the loss calculation formula and the preset threshold value of the total loss $D_N$ of the specific atomizing head 17 being used. The identifying information associated with the specific atomizing head 17 may include at least one of: a combination of patterns, letters, numbers, words, one-dimensional barcodes, two-dimensional codes, three-dimensional codes, magnetic strip labels, and other electronic labels. Loss calculation formulas and preset threshold values of the total loss $D_N$ of multiple types of the atomizing heads 17 are pre-stored in the storage 13. Therefore, the battery assembly 16 can be fitted with at least one type of atomizing head 17, and the storage 13 is not update when an atomizing head 17 is changed or renewed. That the storage contains data for several types of atomizing heads 17, allows for convenient changing of atomizing heads 17, as their function begins to degrade. When the loss calculation formula and the corresponding preset value of the total loss $D_N$ of the at least one type of the atomizing head 17 are stored in other devices, the second detecting device 18 detects the type of the atomizing head 17, and sends the detected type to the other devices, and then the processor 14 receives the corresponding loss calculation formula and the corresponding preset value of the total loss $D_N$ from the other devices.

The present disclosure provides an electronic cigarette 2 with reminding function. The electronic cigarette includes a battery assembly 16, an atomizing head 17, and the controlling apparatus 1 above mentioned.

The present disclosure provides a control method of the electronic cigarette with reminding function. The control method includes following steps, any of which may be omitted or have its order changed.

The first detecting device 11 detects the value $a_N$ of a loss factor for each operation of the atomizing head 17. N is defined as the total number of each operation of the atomizing head 17, and $N \geq 1$. The loss factor may be at least one of the operating voltage, power, temperature, or humidity of the atomizing head 17, and the pH value of the liquid tobacco.

The timer 12 records the individual number of operations N of the atomizing head 17, and an operation duration $t_N$ of the Nth operation.

The processor 14 acquires $a_N$ from the first detecting device 11 and acquires the N and $t_N$ from the timer 12. The processor also acquires the pre-stored loss calculation formula $d_N=\eta_N \times a_N \times t_N$ of the Nth operation, the relational data of $\eta_N$ and N, the total loss calculation formula $D_N=D_{N-1}+d_N$ of the atomizing head 17, and the loss data from the storage 13, to calculate the total loss $D_N$ of the atomizing head 17 after the electronic cigarette operating for N times. $\eta_N$ is defined as the correction factor, and $D_0=0$.

The processor 14 pre-stores $d_N$ and $D_N$ in the storage 13, and compares the total loss $D_N$ with the preset threshold value. If the total loss $D_N$ is greater than or equal to the preset threshold value, the processor 14 instructs the alarming device 15 to transmit an alarm signal.

In other embodiments, the loss calculation formula, the preset value of the total loss $D_N$, and the loss data of the atomizing head 17 can be stored in other external devices instead of the storage 13. When the loss calculation formula, the preset value of the total loss $D_N$, and the loss data of the atomizing head 17 are needed to use, they can be acquired from the other external devices. Additionally, the loss calculation formula in the illustrated embodiment is an example. In actual application, the loss calculation formula can be changed.

The value $a_N$ of loss factor, the N number of times of operation, and the operation duration $t_N$ of the atomizing head 17 are detected in real-time. Using the loss calculation formula and the loss data of the atomizing head 17, the operation loss $d_N$ of the Nth operation and the total loss $D_N$ for N times of the atomizing head 17 are calculated. When the total loss $D_N$ is greater than or equal to the preset threshold value, an alarm signal indicating a need to change in atomizing head 17 is transmitted. Therefore, users can swap an old atomizing head 17 out in place of a new one. Therefore, improving the user experience.

Figure 3:
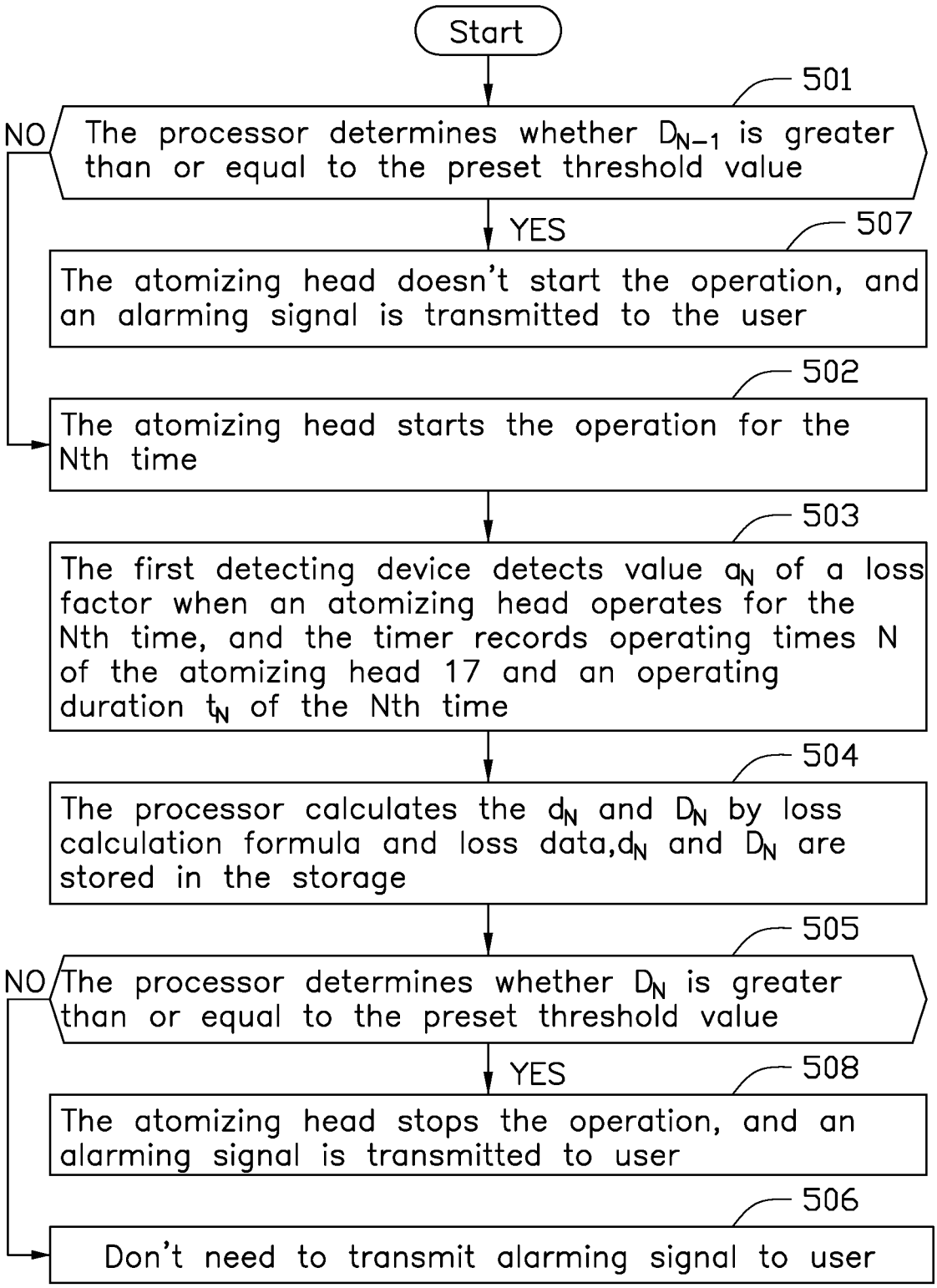
FIG. 3 is a flowchart of a first embodiment of a control method of an electronic cigarette with reminding function.

Referring to FIG. 3, when the storage 13 of the controlling apparatus 1 is arranged in the atomizing head 17, and the first detecting device 11, the timer 12, the processor 14, and the alarming device 15 of the controlling apparatus 1 are arranged in the battery assembly 16, the control method of the electronic cigarette 2 may include any or all of the following steps, and in orders other than described below.

In step 501, the processor 14 compares whether a total loss $D_{N-1}$ of the atomizing head 17 is greater than or equal to the preset threshold value. If the total loss $D_{N-1}$ is greater than or equal to the preset maximum threshold value, the processor 14 causes the atomizing head to stop working, and cause an alarm signal to be transmitted to user. If the total loss $D_{N-1}$ is less than the preset threshold value, the atomizing head 17 starts the Nth operation, in step 502. Then, continuing to step 503, the first detecting device 11 detects the value $a_N$ of a loss factor when the atomizing head 17 operates for the Nth time, and a timer 12 records an operation times associated with the number of operations N of the atomizing head 17 and an operation duration $t_N$ of the Nth time. In step 504, according to formulas and values of $a_N$, $t_N$, N, described above, and the loss data, the processor 14 calculates a operation loss $d_N$ at the Nth time of operation and a total loss $D_N$ after N operations. The values of $d_N$ and $D_N$ are stored in the storage 13. In step 505, the processor 14 compares whether the total loss $D_N$ is greater than or equal to the preset threshold value. If the total loss $D_N$ is greater than or equal to the preset threshold value, the atomizing head 17 is caused to stop working, and at step 508, an alarm signal is transmitted to user. If the total loss $D_N$ is less than the preset threshold value, transmission of an alarm signal to user as step 506 is not required.

When a new atomizing head 17 is used, the N=1 and $D_{N-1}$ and $D_N$ are each equal to 0.

Figure 4:
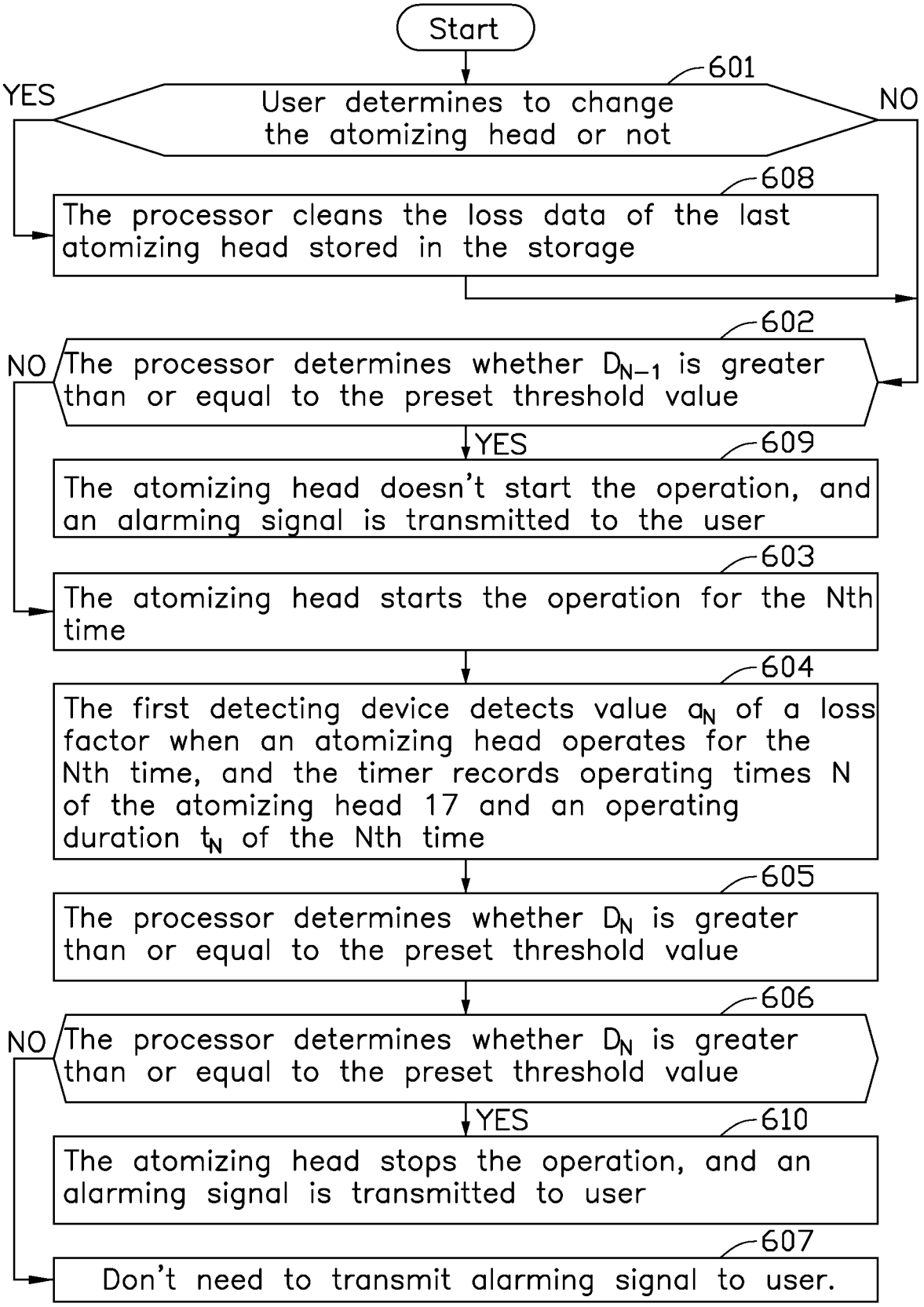
FIG. 4 is a flowchart of a second embodiment of a control method of an electronic cigarette with reminding function.

Referring to FIG. 4, when the first detecting device 11, the timer 12, the storage 13, the processor 14, and the alarming device 15 of the controlling apparatus 1 are arranged in the battery assembly 16, the control method of the electronic cigarette 2 may include any or all of the following steps, and in orders other than described below.

In step 601, it is determined whether the atomizing head 17 needs to be replaced with a new one. If the atomizing head 17 needs to be changed, the processor 14 clears the loss data of the previous atomizing head 17, which is stored in the storage 13, as step 608. The loss data may include at least the number of operations and accumulated loss. Then, the method continues to step 602. If the atomizing head 17 does not need to be replaced, the method continues to step 602 directly. In step 602, the processor 14 compares the total loss $D_{N-1}$ of the atomizing head 17 with the preset threshold value. If the total loss $D_{N-1}$ is greater than or equal to the preset threshold value, the method continues to step 609. In step 609, the atomizing head 17 is caused to stop working, and an alarm signal indicating a need to change the atomizing head 17 is transmitted. If the total loss $D_{N-1}$ is less than the preset threshold value, the method continues to step 603. In step 603, the atomizing head 17 is caused to start operating for the Nth time. Then, the method continues to step 604. In step 604, the first detecting device 11 detects the value $a_N$ of a loss factor when the atomizing head operates for the Nth time, and the timer 12 records the operation times for the number of operations N of the atomizing head 17 and operation duration $t_N$ of the Nth operation. In step 605, according to the formulas above and the values of $a_N$, $t_N$, N, and the loss data, the processor 14 calculates an operating loss $d_N$ for the Nth operation and a total loss $D_N$ after N operations. In addition, the values of $d_N$ and $D_N$ are stored in the storage 13. In Step 606, the processor 14 compares whether the total loss $D_N$ is greater than or equal to the preset threshold value. If the total loss $D_N$ is greater than or equal to the preset threshold value, the atomizing head 17 is caused to stop working and an alarm signal is caused to transmit to user, as step 610. If the total loss $D_N$ is less than the preset threshold value, no alarm signal is transmitted, as step 607.

When a new atomizing head 17 is used, N=1, and $D_{N-1}$ and $D_N$ are equal to 0.

In the step 601, the user can determine for himself whether the atomizing head 17 needs to be changed, and the user can input accordingly to the electronic cigarette 2.

Figure 5:
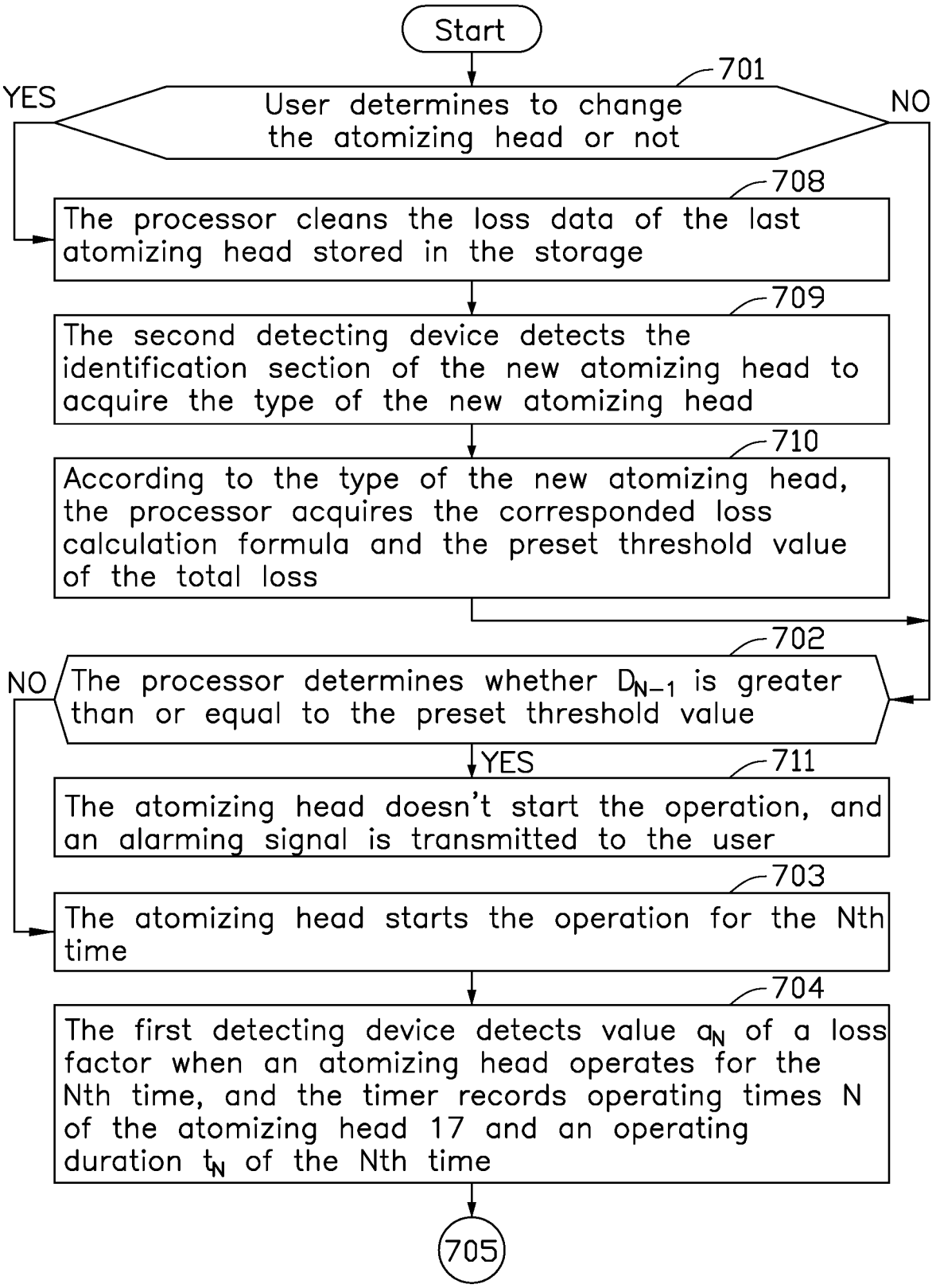
FIG. 5 is a flowchart of a third embodiment of a control method of an electronic cigarette with reminding function.
Figure 6:
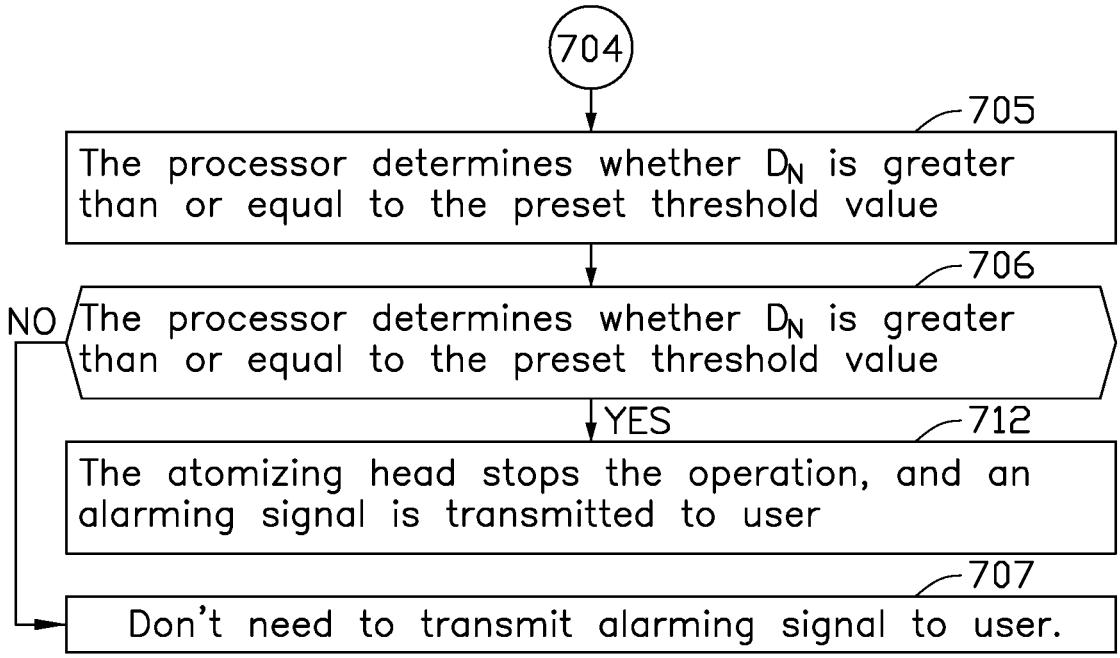
FIG. 6 is a flowchart of the third embodiment of the control method shown in FIG. 5.

Referring to FIG. 5, when the first detecting device 11, the timer 12, the storage 13, the processor 14, and the alarming device 15 of the controlling apparatus 1 are received in the battery assembly 16, the controlling apparatus may further include a second detecting device 18. Such control method of the electronic cigarette 2 includes any or all of the following steps, any of which may be omitted or have its order changed.

In step 701, the user decides whether the atomizing head 17 needs to be changed. If the atomizing head 17 needs to be changed, the processor 14 clears the loss data for the atomizing head being replaced so there is no loss data for the new atomizing head 17 in the storage 13 as step 708. The loss data includes number of operations and accumulated loss. In another embodiment, if the loss data is not stored in the storage 13, an clear instruction can be sent to other devices configured to store the loss data, and the other devices clears the stored loss data after receiving the clear instruction. Then, the method continues to step 709. In step 709, the second detecting device 18 detects the identifying information associated with a new atomizing head 17 to detect the type of the new atomizing head 17. In step 710, according to the type of the new atomizing head 17, the processor 14 acquires the corresponding loss calculation formula and the preset threshold value from the storage 13. Then, the method continues to step 702. If the atomizing head 17 does not need to be changed, the method continues to step 702 directly.

In step 702, the processor 14 compares the total loss $D_{N-1}$ of the atomizing head 17 with the preset threshold value. If the total loss $D_{N-1}$ is greater than or equal to the preset threshold value, the method continues to step 711. In step 711, the atomizing head 17 is caused to stop working, and an alarm signal is caused to transmit to the user. If the total loss $D_{N-1}$ is less than the preset threshold value, the method continues to step 703. In step 703, the atomizing head 17 is caused to start the Nth operation. Then, the method continues to step 704. In step 704, the first detecting device 11 detects the value $a_N$ of a loss factor when the atomizing head operates for the Nth time, and the timer 12 records the operation times for the number of operations N of the atomizing head 17 and the operation duration $t_N$ of the Nth operation. In step 705, according to the formulas above and the values of $a_N$, $t_N$, N, and the loss data, the processor 14 calculates an operating loss $d_N$ for the Nth operation and total loss $D_N$ after N operations. In addition, the values of $d_N$ and $D_N$ are stored in the storage 13. In step 706, the processor 14 compares whether the total loss $D_N$ is greater than or equal to the preset threshold value. If the total loss $D_N$ is greater than or equal to the preset threshold value, the method continues to step 712. In step 712, the atomizing head 17 is caused to stop working, and an alarm signal indicating a need to change the atomizing head 17 is transmitted to user. If the total loss $D_N$ is less than the preset threshold value, no alarm signal is transmitted, as step 707.

When a new atomizing head 17 is used, the N=1, $D_{N-1}$ and $D_N$ are equal to 0.

In step 701, the user can determine for himself whether the atomizing head 17 needs to be changed to a new one, and the user can input accordingly to the electronic cigarette 2.

The various exemplary logical blocks, modules, circuits, and algorithm steps described in above embodiments can be implemented as an electronic hardware, or a computer software, or a combination of both. In order to clearly explain the interchangeability of the hardware and software, the function of the exemplary logical blocks, devices, circuits, and algorithm steps are described in general operation. The function is implemented as software or hardware depending on specific application and design constraints imposed on the entire system. Skilled persons in this field cam implement the function in a variety of ways for each specific application, but the way of implementation should not be interpreted as an exclusion of the scope of the present disclosure.

The present disclosure further provides an electronic cigarette with reminding function. The electronic cigarette includes a storage and a processor. At least one program instruction is stored in the storage. The at least one program instruction is executed in the processor to implement the control method described above. Preferably, the processor stores other parameters needed for executing the program. For example, the loss calculation formula and the loss data described above can be stored in the processor.

The present disclosure further provides a computer storage media. The computer storage media includes at least one program instruction. The at least one program instruction is executed in the processor to implement the control method described above.

Even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A controlling apparatus with reminding function for use with an atomizing head, comprising:

a first detecting device configured to detect a value $a_N$ of a loss factor when an atomizing head works at an Nth time, "N" represents number of operations of the atomizing head, $N \geq 1$; the first detecting device is further configured to detect N, N is the number of operations of the atomizing head;

a timer configured to record an operation duration $t_N$ at the Nth operation;

a processor configured to calculate an operating loss $d_N$ of the atomizing head at the Nth operation according to the value of $a_N$, $t_N$, and a loss calculation formula, to calculate a total loss $D_N$ after operation for N times according to the operating loss $d_N$ and an operating loss after operation for (N−1) times, $D_0=0$, and to compare the total loss $D_N$ with a preset threshold value, when the total loss $D_N$ is greater than or equal to the preset threshold value, the processor causing an alarming device to transmit an alarm signal; and the alarming device configured to transmit the alarm signal;

the processor is further configured to acquire a correction factor $\eta_N$ corresponded to the number of operations N, and to calculate the operating loss $d_N$ of the atomizing head at the Nth operation according to the value of $a_N$, $t_N$, $\eta_N$, and the loss calculation formula.

2. The controlling apparatus as claimed in claim 1, wherein the value of $d_N$ calculated by the processor is calculated by the formula of:

$$d_N=\eta_N \times a_N \times t_N.$$

3. The controlling apparatus as claimed in claim 1, wherein the loss factor comprises at least one of an operating voltage, power, temperature or humidity of atomizing head, and a pH value of the tobacco juice.

4. The controlling apparatus as claimed in claim 1, wherein the first detecting device, the timer, the processor, and the alarming device are positioned in a battery assembly.

5. The controlling apparatus as claimed in claim 1, wherein the controlling apparatus further comprises a storage, the storage is configured to store the loss calculation formula and the operating loss after operation for (N−1) times.

6. The controlling apparatus as claimed in claim 5, wherein the storage is positioned in the atomizing head or in the battery assembly.

7. The controlling apparatus as claimed in claim 5, wherein the controlling apparatus further comprises a second detecting device, the second detecting device is configured to detect a type of a new atomizing head via identifying information associated with the atomizing head, and to instruct the processor to get the loss calculation formula and the preset threshold value of the total loss $D_N$ of the new atomizing head from the storage, loss calculation formulas and corresponding preset threshold values of the total loss $D_N$ of more than one type of the atomizing head are pre-stored in the storage.

8. The controlling apparatus as claimed in claim 7, wherein the identifying information comprises at least one or a combination of patterns, letters, numbers, words, one-dimensional barcodes, two-dimensional codes, three-dimensional codes, magnetic stripe labels, and electronic labels.

* * * * *